US006398522B2

(12) United States Patent
Skill

(10) Patent No.: US 6,398,522 B2
(45) Date of Patent: Jun. 4, 2002

(54) PUMP

(75) Inventor: Stephen Skill, Nottingham (GB)

(73) Assignee: Photosynthesis (Jersey) Limited, St. Heller ( * ) Notice: Subject to any disclaimer, the term of this patent is extended or adjusted under 35 U.S.C. 154(b) by 0 days.

(21) Appl. No.: 09/737,350

(22) Filed: Dec. 15, 2000

Related U.S. Application Data

(63) Continuation of application No. PCT/GB99/01944, filed on Jun. 21, 1999.

(30) Foreign Application Priority Data

Jun. 19, 1998 (GB) ..... 9813342
Aug. 21, 1998 (GB) ..... 9818322

(51) Int. Cl.[7] ..... F04B 17/00
(52) U.S. Cl. ..... 417/410.3
(58) Field of Search ..... 417/410.3, 355, 417/356; 418/1, 153, 154

(56) References Cited

U.S. PATENT DOCUMENTS 3,169,485 A * 2/1965 Sadler et al. ..... 417/DIG. 1
4,492,541 A * 1/1985 Mallen-Herrero et al. .. 188/290
5,163,825 A * 11/1992 Oetting ..... 418/153
5,449,280 A * 9/1995 Maki et al. ..... 415/141
5,636,178 A * 6/1997 Ritter ..... 367/83
5,743,718 A * 4/1998 Mendoza et al. ..... 415/141
6,213,740 B1 * 4/2001 Barnes ..... 418/153
6,264,450 B1 * 7/2001 Woodruff ..... 415/140

FOREIGN PATENT DOCUMENTS

| | | |
|---|---|---|
| GB | 672522 | 8/1950 |
| GB | 649814 | 1/1951 |
| GB | 1061278 | 5/1967 |

* cited by examiner

*Primary Examiner*—Teresa Walberg
*Assistant Examiner*—Vinod Patel
(74) *Attorney, Agent, or Firm*—Ceasar, Rivise, Bernstein, Cohen & Pokotilow, Ltd.

(57) ABSTRACT

A pump has flexible vanes arranged in a helical path in the clearance between the stator and the rotor. In one form, the helically wound vanes are present on the rotor, the stator including at least one can surface to flex the vanes. In another form, the helically wound vanes are present on the stator, the rotor including at least one can surface to flex the vanes.

24 Claims, 3 Drawing Sheets

PUMP

This application is a continuation of and claims benefit under 35 U.S.C. §365(c) of co-pending International Application No. PCT/GB99/01944, filed on Jun. 21, 1999, which in turn, claims priority of pending British Patent Application Nos. 9813342.4, filed on Jun. 19, 1998 and 9818322.1, filed on Aug. 21, 1998, the entire disclosures of which are incorporated by reference herein.

The invention relates to a pump capable of a range of industrial uses. The pump is of particular value in the pumping of nutrient liquid to feed a culture of micro-organisms and so will be described in relation to that use, but by way of illustration only. The pump can however be used on other applications, e.g. in medical equipment.

A pump can comprise a generally cylindrical stator containing an elongate rotor with spaced apart radial, flexible vanes disposed thereabout, as previously disclosed in British Patent No. 649814 to the H. J. Rand Washing Machine Corporation, British Patent No. 672522 to Mayus and See and in British Patent No. 1061278 to the Jabsco Pump Company.

The instant invention is based on the realisation that a pump comprising a generally cylindrical stator containing an elongate rotor can be improved if the flexible vanes are present in the clearance between the rotor and the stator and that they are disposed on either the stator or the rotor in a helical fashion.

According to the invention in one aspect there is provided a pump comprising a stator having a generally cylindrical bore which contains a rotor, one of the stator and the rotor containing radially spaced apart vanes and the other of the stator and rotor having at least one radial deformation, the vanes being flexible and extending in a generally helical manner from one end of the shaft or the rotor towards the other and the deformation being disposed and arranged to flex the vanes when they meet the deformation.

According to the invention in a specific aspect there is provided a pump comprising a stator and a rotor, the stator having a generally cylindrical bore in which is disposed the rotor, the rotor carrying spaced apart radial vanes and the stator having at least one radial deformation, the vanes being flexible and extending in a generally helical manner from one end of the rotor towards the other and the deformation being disposed and adapted to flex the vanes when they meet the deformation. I have also described and claimed a method of using the pump.

It is possible to reverse the location of the co-operating vanes and cam deformation surfaces within the pump.

In another specific aspect therefore the invention provides a pump comprising a stator and a rotor, the stator having a generally cylindrical bore, on an inner surface of which there is mounted spaced apart radial vanes, the rotor being disposed within said bore and having at least one radial deformation, the vanes being flexible and extending in a generally helical manner from one end of the stator towards the other and the deformation being disposed and adapted to flex the vanes when they meet the deformation.

The number of deformations may be varied. If a number of such surfaces is substantially evenly distributed about the major axis of the stator the rotor will be centred.

The vanes may be made of any suitable natural synthetic material, typically a plastics, including where appropriate a biopolymer. They make take any suitable shape and preferably comprising a thin vertical web having an enlarged head. The design of the vanes will be related to the deformation surface(s) which act as a cam to flex the vanes as they go past the deformation.

The pump may be connected to or be incorporated in a prime mover, for example, an electromagnetic drive system. The pump may be used for liquids or gases and may, for example, be used in association with a gas compressor.

A further aspect of the invention provides a bearing-free pump comprising a stator having an inlet and an outlet and being provided with at least one radial deformation, and a rotor carrying spaced apart radial vanes which extend in a generally helical manner from one end of the rotor toward the other, the vanes being adapted to flex on contact with said deformation, and wherein the rotor is moveable in response to a fluid-flow failure.

In another aspect the invention provides a method of pumping a fluid by rotation of a rotor in the generally cylindrical bore of a stator, one of the stator and the rotor carrying radially spaced apart flexible vanes and the other of the stator and the rotor at least one radial vane deflecting means, the vanes extending in a generally helical manner from one end of the stator towards the other, the method comprising rotating the rotor in the stator and flexing the vanes as they move past the vane deflecting means, whereby fluid between neighbouring vanes is caused to move along the rotor helically in addition to circumferentially.

In a specific aspect the invention provides a method of pumping a fluid by rotation of a rotor in the generally cylindrical bore of a stator, the rotor carrying spaced apart radial flexible vanes and the stator being provided with at least one radial deformation, the vanes extending in a generally helical manner from one end of the rotor towards the other, the method comprising rotating the rotor in the stator and flexing the vanes as they move past one deformation, whereby fluid between neighbouring vanes is caused to move along the rotor helically in addition to circumferentially.

In another aspect the invention provides a method of pumping a fluid by rotation of a rotor in the generally cylindrical bore of a stator, the stator carrying spaced apart radial flexible vanes and the rotor being provided with at least one radial deformation, the vanes extending in a generally helical manner from one end of the stator towards the other, the method comprising rotating the rotor in the stator and flexing the vanes as they move past one deformation, whereby fluid between neighbouring vanes is caused to move along the rotor helically in addition to circumferentially.

A pump of the invention may be used to transport liquids such as blood or stiff slurries, e.g. cement based slurries, or in a multistage bore pump in, e.g. oil wells. If any solid particles become trapped between the vanes and the inner surface of the stator the vanes will flex so allowing the pump to continue operating, especially when a number of cam surfaces is present.

Other features of the invention are set out in the dependent claims.

In order that the invention may be well understood it will be described by way of example with reference to the accompanying diagrammatic drawings, in which.

The same reference numerals are used to describe the different embodiments where convenient.

Figure 1:
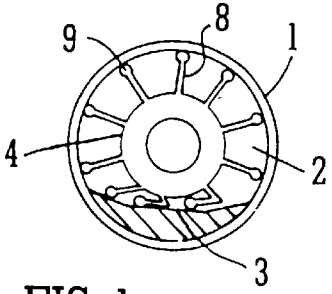
FIG. 1 is an end elevation of one pump of the invention.

The pump comprises an elongate stator 1 formed of generally rigid material such as metal or plastics or ceramic or the like. The stator 1 has a generally circular bore 2 having a chordal deformation to act as a cam surface 3. This may be an infill or machined in place. The stator 1 contains a rotor 4 having an elongate shaft 5 made of say stainless steel. The shaft 5 is connected to a prime mover, not shown. A sleeve 6 is secured to the shaft 5 and is made say of plastics or rubber. Vanes 7 are present on the sleeve 6, each comprising a radial web extension 8 and ending in a bulbous head 9. The vanes 7 are secured in parallel and extend along a helical path which travels along the sleeve length. If one cam surface 3 is present as shown the path will travel 360° but if more than one cam surface is present the travel will be less, e.g. for 4 cams the travel can be 90°. The vanes 7 are dimensioned such that when the vanes are at rest remote from the cam 3 the shaft 5 is self centred. It will be noted that although the pump is devoid of bearings or seals, it is self centring.

In use, the rotor 4 is placed in the stator 1 in a liquid flow path and the pump is energised by means, not shown. As a shaft 5 rotates the vanes 7 reach the cam face 3 where they are compressed (see FIG. 1) giving the liquid flow an extra kick. Because the vanes 7 are on a helical path the liquid flows helically which is advantageous.

Figure 2:
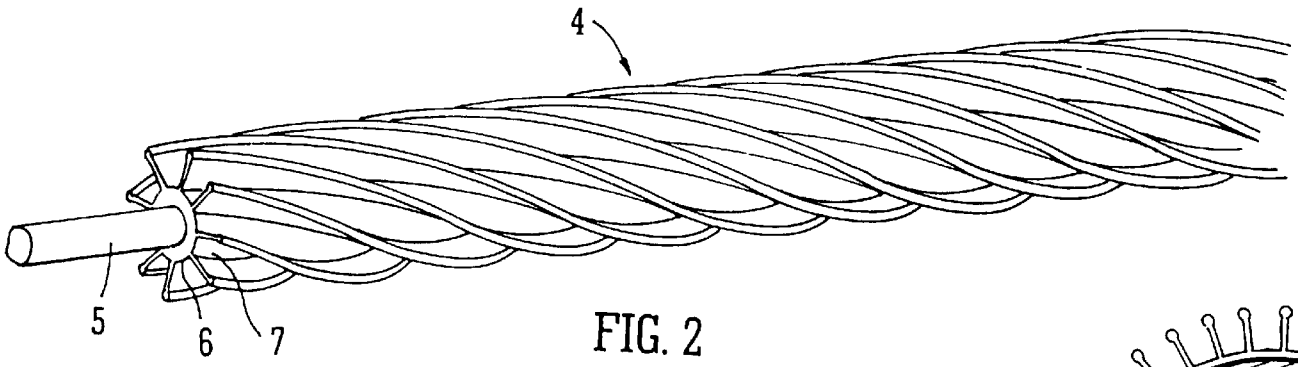
FIG. 2 is a perspective view from one end of the rotor.
Figure 3:
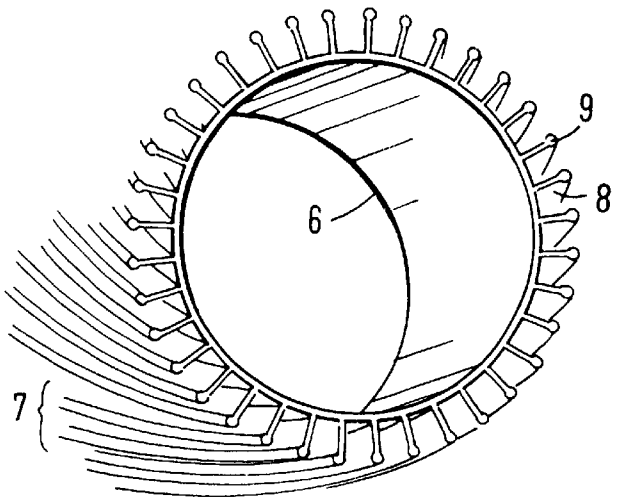
FIG. 3 is a front elevation showing the flow of liquid.
Figure 4:
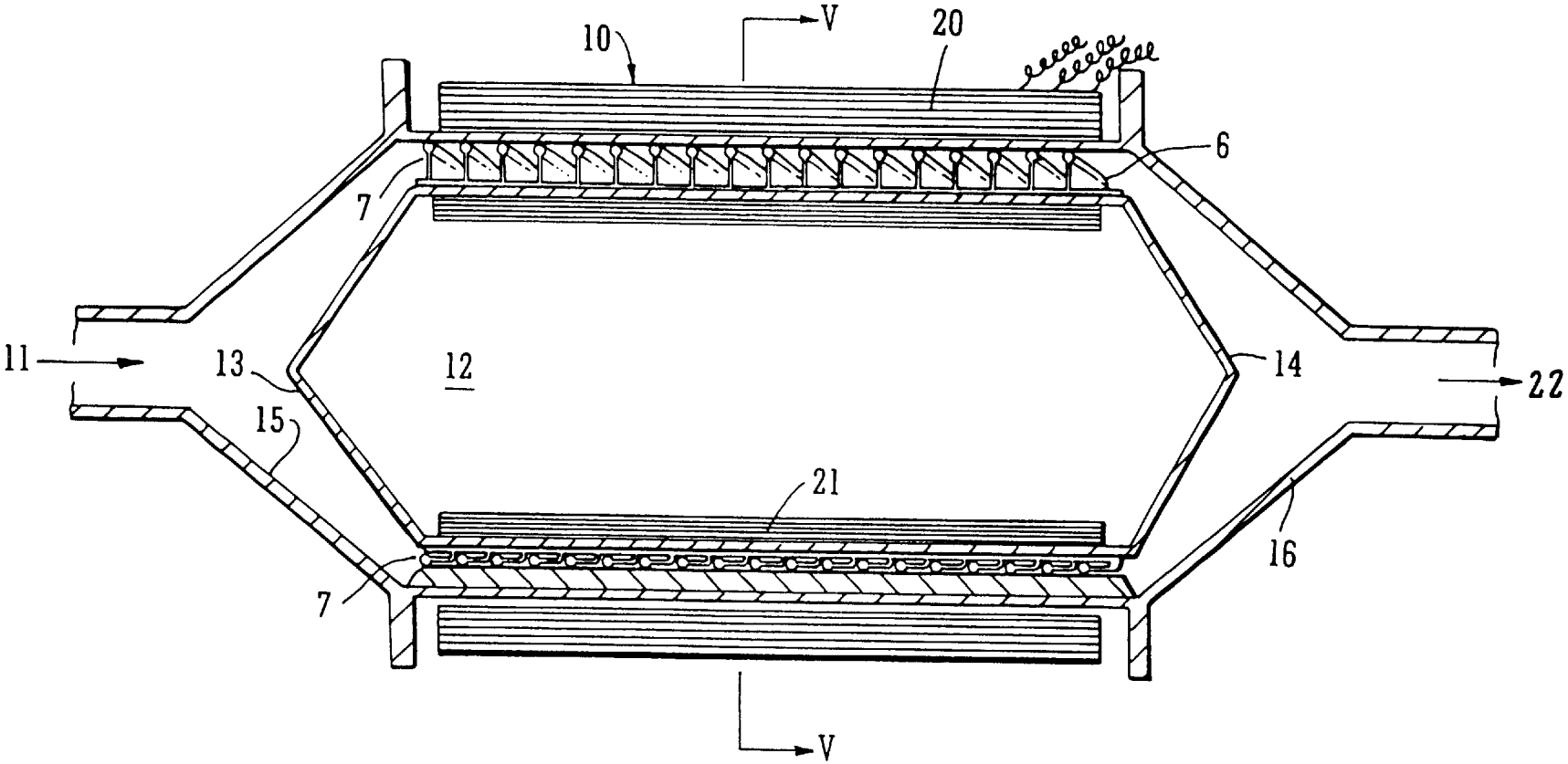
FIG. 4 is a side elevation of a second pump of the invention.
Figure 5:
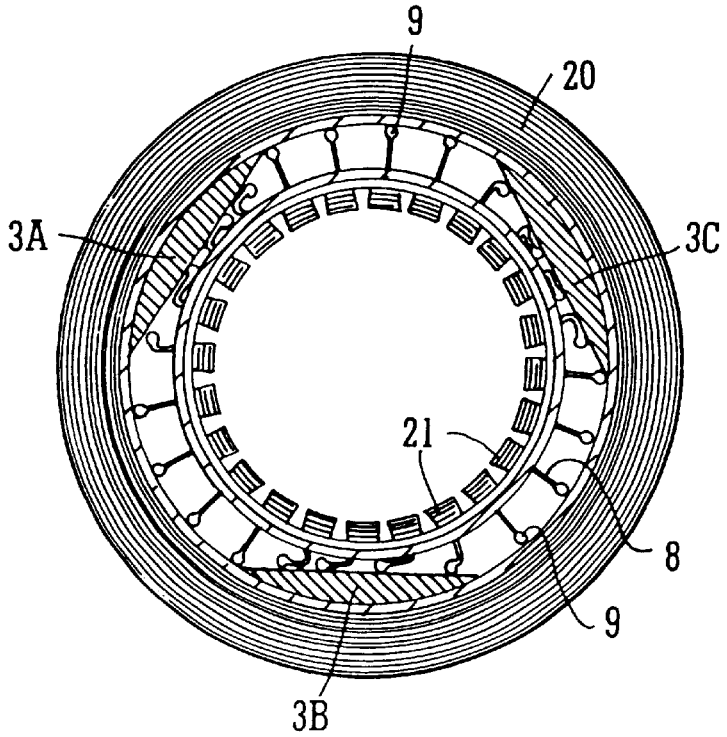
FIG. 5 is a sectional view taken on lines V—V on FIG. 4.

In the embodiment of FIGS. 4 and 5 the pump comprises a shell 10 (acting as the stator) and having a side inlet 11 and an inline outlet 22. The rotor 12 is a closed body having cone shaped ends 13, 14 shaped to correspond to the facing surfaces of the inlet and outlet walls 15, 16 respectively. Vanes 7 mounted on or integral with sleeve 6 are present on the rotor body 12. The inside of the stator 10 has three deformation or cam surfaces 3A, 3B, 3C substantially evenly spread about the inner surface of the stator 10. An electromagnetic coil 20 is mounted on the outside of the stator 10 and a set of magnets 22 is mounted inside the rotor body 12. The magnets 20, 21 co-operate in known manner when energised from a power source to drive the pump which works as described in relation to the embodiment of FIGS. 1 to 3. In use the cams 3A, 3B, 3C by flexing vanes 7 at any one time will tend to centre the rotor 12. If the pump fails in any way, the fluid under the higher pressure will force the rotor 12 to move to seal the inlet or outlet by engagement of the surfaces 13, 15 or 14, 16.

Figure 6:
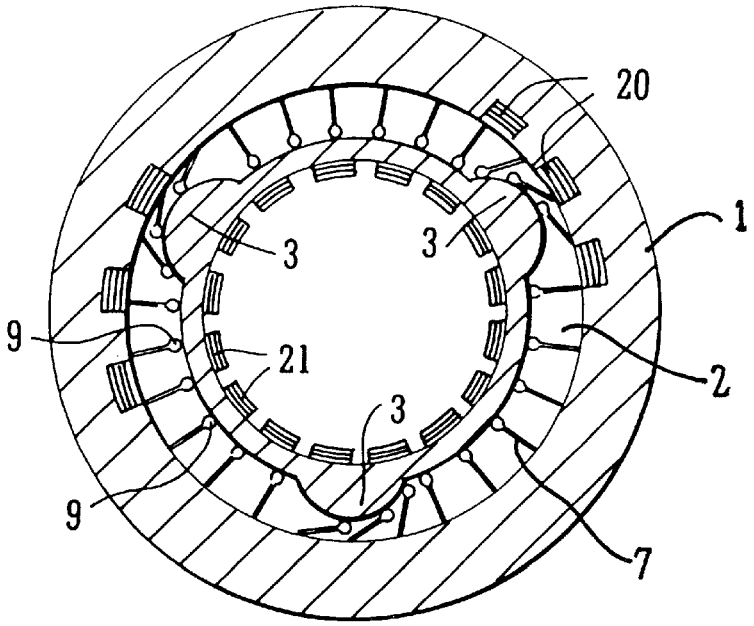
FIG. 6 is a sectional view of a third pump of the invention.

In the embodiment of FIG. 6, the vanes 7 are mounted on the inner surface of the bore 2 of the stator 1 and three cams 3 are spaced about the circumference of the rotor 4. Electromagnets 20, 21 are present, as in the embodiment of FIGS. 4 and 5. The diameter of the bore 2 in this embodiment may be relatively larger than in the earlier ones. The apparatus works in the same way as the previous embodiments and pumped fluid is caused to flow both circumferentially and helically of the rotor 4.

The invention is not limited to the embodiment shown. The number of vanes may be varied but two or more are usually required to prevent back flow. The stator may be made of a rigid or semi-rigid material; more than one cam surface may be present. More than one pump of the invention may be present in a system, either in parallel or in series. The fluid pumped may be liquid or gaseous liquid. The pump may be made of lightweight materials. The length of the stator and rotor will depend on the use to which the pump is to be put.

What is claimed is:

1. A pump comprising a stator and a rotor, the stator having a generally cylindrical bore in which is disposed the rotor, the rotor carrying spaced apart radial vanes and the stator having at least one radial deformation, the vanes being flexible and extending in a generally helical manner from one end of the rotor towards the other and the deformation being disposed and adapted to flex the vanes when they meet the deformation.

2. A pump according to claim 1, wherein the stator is elongate and generally cylindrical in shape and the rotor is elongate and co-axial therewith, the vanes being secured to the surface of the rotor and being in contact with the inner wall of the stator.

3. A pump according to claim 2, wherein the at least one deformation is longitudinally disposed along the stator.

4. A pump according to claim 1, comprising a plurality of radial deformations, which are substantially uniformly spaced about the axis of the stator.

5. A pump according to claim 1, comprising drive electromagnets.

6. A pump according to claim 1, being devoid of bearings or seals.

7. A pump according to claim 1, wherein the rotor is moveable, with respect to the stator, in response to a fluid-flow failure, to seal the pump.

8. A pump according to claim 7, wherein the rotor comprises a surface portion which engages, as a consequence of rotor movement, a surface of the stator, thereby preventing further fluid flow.

9. A pump comprising a stator and a rotor, the stator having a generally cylindrical bore, on an inner surface of which there is mounted spaced apart radial vanes, the rotor being disposed within said bore and having at least one radial deformation, the vanes being flexible and extending in a generally helical manner from one end of the stator towards the other and the deformation being disposed and adapted to flex the vanes when they meet the deformation.

10. A pump according to claim 9, wherein the stator is elongate and generally cylindrical in shape and the rotor is elongate and co-axial therewith, the vanes being secured to the inner wall of the stator and being in contact with the surface of the rotor.

11. A pump according to claim 9, wherein the at least one deformation is longitudinally disposed along the rotor.

12. A pump according to claim 9, comprising a plurality of radial deformations, substantially uniformly spaced about the axis of the rotor.

13. A pump according to claim 9 further comprising drive electromagnets.

14. A pump according to claim 9, being devoid of bearings or seals.

15. A bearing-free pump comprising a stator having an inlet and an outlet and being provided with at least one radial deformation, and a rotor carrying spaced apart radial vanes which extend in a generally helical manner from one end of the rotor toward the other, the vanes being adapted to flex on contact with said deformation, and wherein the rotor is moveable in response to a fluid-flow failure.

16. A pump according to claim 15, wherein the rotor is self-centring with respect to the stator.

17. A pump according to claim 15, wherein the rotor is moveable to seal the pump.

18. A pump according to claim 15, wherein the stator and rotor are electromagnetically coupled.

19. A method of pumping a fluid by rotation of a rotor in the generally cylindrical bore of a stator, the rotor carrying spaced apart radial flexible vanes and the stator being provided with at least one radial deformation, the vanes extending in a generally helical manner from one end of the rotor towards the other, the method comprising rotating the rotor in the stator and flexing the vanes as they move past one deformation, whereby fluid between neighbouring vanes is caused to move along the rotor helically in addition to circumferentially.

20. A method according to claim 19, wherein the fluid is a liquid such as blood or water.

21. A method according to claim 19, wherein the fluid is a slurry.

22. A method of pumping a fluid by rotation of a rotor in the generally cylindrical bore of a stator, the stator carrying spaced apart radial flexible vanes and the rotor being provided with at least one radial deformation, the vanes extending in a generally helical manner from one end of the stator towards the other, the method comprising rotating the rotor in the stator and flexing the vanes as they move past one deformation, whereby fluid between neighbouring vanes is caused to move along the rotor helically in addition to circumferentially.

23. A method according to claim 22, wherein the fluid is a liquid such as blood or water.

24. A method according to claim 22, wherein the fluid is a slurry.

* * * * *